US010483056B2

(12) United States Patent
Wakuda

(10) Patent No.: US 10,483,056 B2
(45) Date of Patent: Nov. 19, 2019

(54) PUSH SWITCH AND ELECTRONIC DEVICE INCLUDING PUSH SWITCH

(71) Applicants: CITIZEN ELECTRONICS CO., LTD., Yamanashi-ken (JP); CITIZEN WATCH CO., LTD., Tokyo (JP)

(72) Inventor: Ryo Wakuda, Kofu (JP)

(73) Assignees: CITIZEN ELECTRONICS CO., LTD., Yamanashi-Ken (JP); CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 15/647,625

(22) Filed: Jul. 12, 2017

(65) Prior Publication Data

US 2018/0025860 A1 Jan. 25, 2018

Related U.S. Application Data

(60) Provisional application No. 62/365,481, filed on Jul. 22, 2016.

(51) Int. Cl.

| | |
|---|---|
| ***H01H 13/14*** | (2006.01) |
| ***H01H 13/50*** | (2006.01) |
| *H01H 13/02* | (2006.01) |

(52) U.S. Cl.
CPC ..... *H01H 13/14* (2013.01); *H01H 13/50* (2013.01); *H01H 13/023* (2013.01)

(58) Field of Classification Search
CPC ..... H01H 13/14; H01H 13/50; H01H 13/023
USPC ..... 200/275, 314, 341, 406, 516, 520, 513
See application file for complete search history.

(56) References Cited

U.S. PATENT DOCUMENTS

| | | | | |
|---|---|---|---|---|
| 6,262,383 | B1 * | 7/2001 | Nishikawa | H01H 13/48 200/406 |
| 7,060,923 | B2 * | 6/2006 | Pihlaja | H01H 13/702 200/512 |
| 7,485,824 | B2 * | 2/2009 | Rastemborski | H01H 13/48 200/406 |
| 8,410,381 | B2 * | 4/2013 | Yanai | H01H 13/06 200/275 |
| 2006/0065514 | A1 | 3/2006 | Toyama | |

FOREIGN PATENT DOCUMENTS

| | | |
|---|---|---|
| JP | 04-129117 | 4/1992 |
| JP | 2008-027642 | 2/2008 |

* cited by examiner

*Primary Examiner* — Edwin A. Leon
*Assistant Examiner* — Lheiren Mae A Caroc
(74) *Attorney, Agent, or Firm* — Wenderoth, Lind & Ponack, L.L.P.

(57) ABSTRACT

In a first aspect of the present disclosure, a push switch includes a resilient member that is made of metal, and the resilient member including a concave shape and an opening that is positioned at a center of the concave shape and at least two protrusions each protruding outward and downward with an oblique angle around the concave shape.

11 Claims, 10 Drawing Sheets

PUSH SWITCH AND ELECTRONIC DEVICE INCLUDING PUSH SWITCH

CROSS-REFERENCE TO RELATED APPLICATION

This application is a new U.S. patent application that claims benefit of U.S. provisional application No. 62/365,481 filed on Jul. 22, 2016, the disclosures of which are incorporated herein by reference in its entirety.

BACKGROUND

Field

The subject matter herein generally relates to a push switch, and relates to an electronic device including the push switch.

Various electronic devices include push switches, and various electronic devices may include computers, portable communication devices, wearable devices, and game consoles, for example.

Description of the Related Art

It is open to the public that a conventional push switch includes a housing, a stem arranged in the housing, a switching portion including a movable contact that is positioned under the stem to switch on or off through the stem, metal plates partly embedded in the housing, and LEDs (light-emitting diodes) arranged on either side of the stem in the housing and electrically connected to the metal plates that are partly embedded in the housing (For reference, see Japanese Unexamined Patent Application Publication No. H4-129117).

Also, it is open to the public that a lighted switch including a substrate, a switch arranged on a first surface of the substrate, a light source arranged on a second surface of the substrate, a key top to press the switch, and a light guide mechanism including a first light guiding member to hold the key top and a second light guiding member arranged to surround the light source to guide light emitted from the light source, guided through the second light guiding member to the first light guiding member holding the key top (For reference, see US Unexamined Patent Application Publication No. 2006/0065514).

Furthermore, it is open to the public that a lighted switch includes a switch substrate, an LED mounted on the switch substrate, a contact fixed on the switch substrate, a spring plate arranged over the contact fixed on the switch substrate and including an opening in which the LED is arranged in a plan view (For reference, Japanese Unexamined Patent Application Publication No. 2008-27642).

SUMMARY

In a first aspect of the present inventive subject matter, a push switch includes a resilient member made of metal and includes a concave shape, an opening that is positioned at a center of the concave shape, and at least two protrusions each protruding outward and downward with an oblique angle around the concave shape.

In a second aspect of the present inventive subject matter, a push switch includes a resilient member including a concave shape, a flat portion that is extended outward from an outer edge of the concave shape, and four protrusions. The four protrusions each protrude outward and downward with an oblique angle from an outer edge of the flat portion.

In a third aspect of the present inventive subject matter, a push switch includes an electrically-insulating member; upper electrodes arranged on an upper surface of the electrically-insulating member and including a first electrode and a second electrode that is positioned outside of the first electrode; a resilient member including a concave shape and an opening that is positioned at a center of the concave shape. The resilient member includes an annular portion that defines the opening and is in contact with the first electrode of the upper electrodes. The push switch further includes a light-emitting element arranged in the opening that is positioned at the center of the concave shape of the resilient member. The resilient member further includes a flat portion that is extended outward from an outer edge of the concave shape and a protrusion protruding outward and downward with an oblique angle from an outer edge of the flat portion. The protrusion of the resilient member includes an end that is arranged above the second electrode.

DETAILED DESCRIPTION OF EMBODIMENTS

Figure 1A:
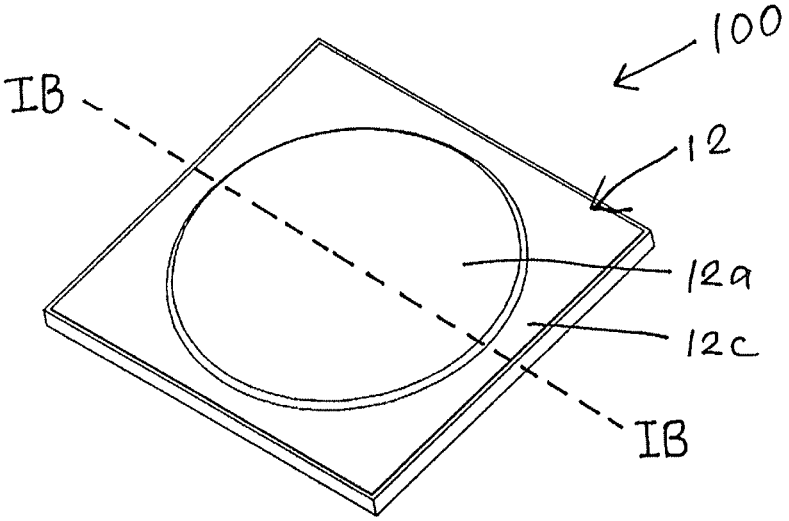
FIG. 1A is a top perspective view of a push switch according to a first embodiment of the subject matter.
Figure 1B:
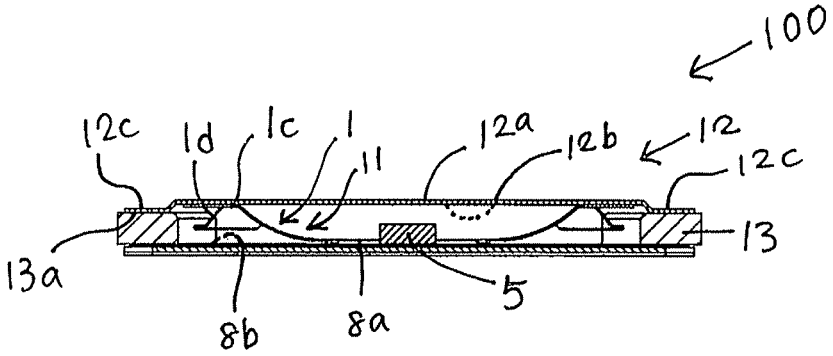
FIG. 1B is a cross-sectional view of the push switch, taken along a dotted line IB of FIG. 1A.
Figure 1C:
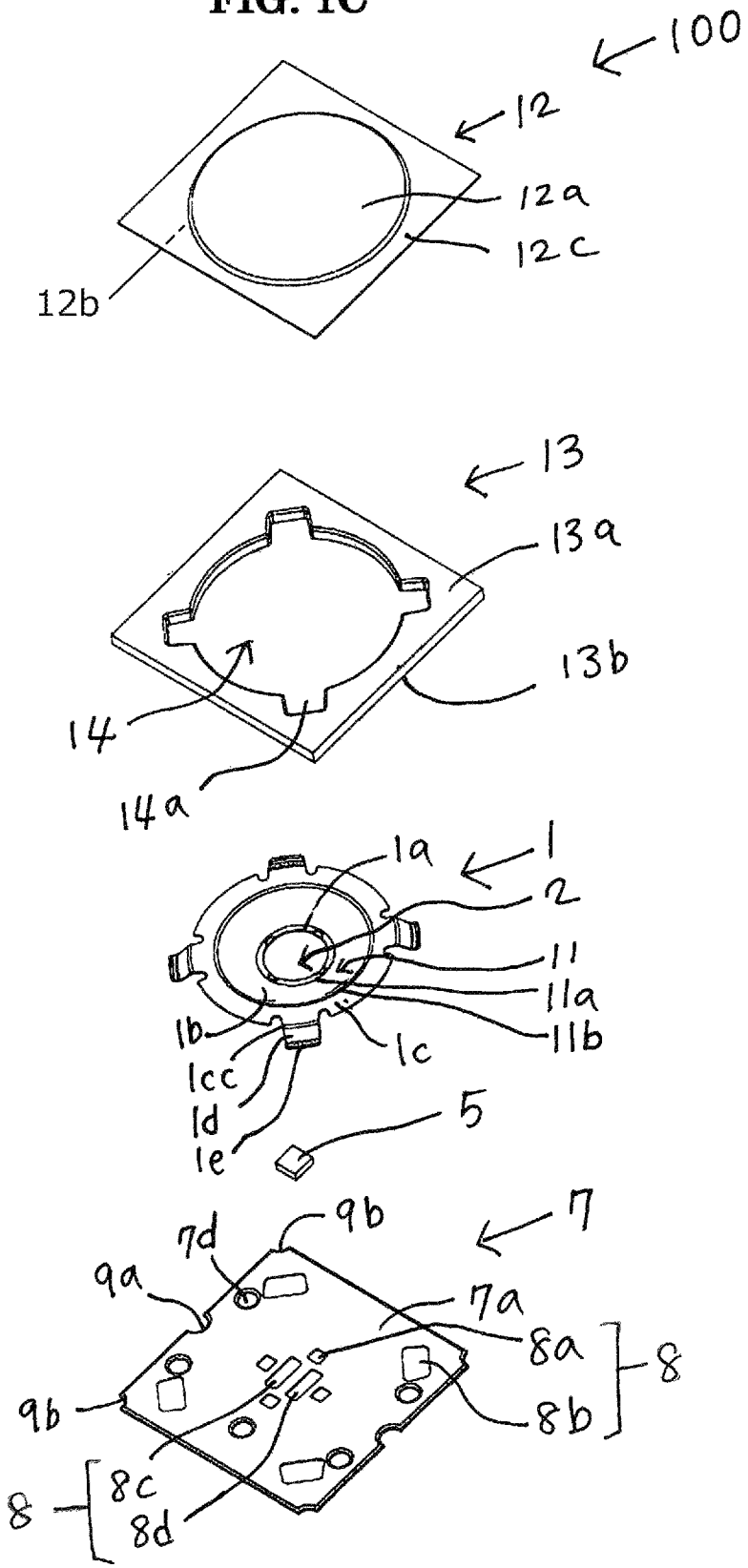
FIG. 1C is an exploded perspective view of the push switch according to the first embodiment of the subject matter.

As used herein, the term "and/or" includes any and all combinations of one or more of the associated listed items.

The terminology used herein is for the purpose of describing particular embodiments only and is not intended to be limiting of the subject matter. As used herein, the singular forms "a", "an" and "the" are intended to include the plural forms as well, unless the context clearly indicates otherwise.

As illustrated in the figures submitted herewith, some sizes of structures or portions may be exaggerated relative to other structures or portions for illustrative purposes.

Relative terms such as "below" or "above" or "upper" or "lower" or "top" or "bottom" may be used herein to describe a relationship of one element, layer or region to another element, layer or region as illustrated in the figures. It will be understood that these terms are intended to encompass different orientations of a device in addition to the orientation depicted in the figures.

A push switch 100 according to a first embodiment of the subject matter will be described with reference to FIGS. 1A to 1G.

The push switch 100 includes a resilient member 1 made of metal. The resilient member 1 includes a concave shape 11 and an opening 2 that is positioned at a center of the concave shape 11. The resilient member 1 further includes at least two protrusions 1*d* each protruding outward and downward with an oblique angle around the concave shape 11.

The push switch 100 may further include a light-emitting element 5 arranged in the opening 2 that is positioned at the center of the concave shape 11 of the resilient member 1. The opening 2 is positioned at a bottom of the concave shape 11. The concave shape 11 of the resilient member 1 surrounding the light-emitting element 5 may include a curved surface 1*b*.

The light-emitting element 5 may be a light-emitting diode (LED). The light-emitting element 5 may include a phosphor layer. Also, the light-emitting element 5 may be sealed by a light-transmitting resin. The light-transmitting resin may be transparent or translucent to transmit light. The light-transmitting resin may include a phosphor.

When the light-emitting element 5 is activated to emit light by application of voltage to the light-emitting element 5, the concave shape 11 of the resilient member 1 is configured to reflect light from the light-emitting element 5 upward. The resilient member 1 made of metal. The resilient member 1 may be made of stainless steel.

The push switch 100 may include a film 12 arranged over the resilient member 1 with the opening 2 in which the light-emitting element 5 is arranged. The film 12 may be a light-transmitting film made of resin.

Light emitted from the light-emitting element 5 and reflected light on a the curved surface 1*b* in the concave shape 11 of the resilient member 1 are configured to transmit the film 12 that may be transparent or translucent.

The film 12 may be made of polyimide resin, for example. Also, the film 12 may be made of fluorine resin. The resilient member 1 may be partly in contact with a lower surface 12*b* of the film 12.

The film 12 may be adhered to an upper surface 13*a* of a frame 13 at a peripheral portion 12*c* of the film 12. The frame 13 may include a projecting portion (not shown) at a lower surface 13*b* of the frame 13 to position the frame 13 on an upper surface 7*a* of an electrically-insulating member (a substrate) 7.

Also, the electrically-insulating member 7 may include a recessed portion 7*d* to receive the projecting portion of the frame 13. Also, the electrically-insulating member 7 may include an air hole 7*e* that may pass through the electrically-insulating member 7.

Whether providing a projecting portion at the lower surface 13*b* of the frame 13 or not can be freely chosen. The number, shape and arrangement of projecting portion to position the frame 13 are freely chosen according to the shape, size and arrangement of the electrically-insulating member 7, for example.

A push switch according to the subject matter may be used in various electronic devices. Such an electronic device includes a push switch including a light-emitting element. The electronic device may be a computer, portable communication device, wearable device, and game console, on-vehicle device for example. An electronic device may require a push switch that is configured to emit light.

As noted above, the push switch 100 includes the resilient member 1. The resilient member 1 includes the concave shape 11 and the opening 2 that is positioned at the center of the concave shape 11. The push switch 100 further includes a flat portion 1*c* that is extended outward from an outer edge 11*b* of the concave shape 11, and the protrusion 1*d* protruding outward and downward with an oblique angle from an outer edge 1*cc* of the flat portion 1*c*.

The push switch 100 may further include the light-emitting element 5 arranged in the opening 2 that is positioned at the center of the concave shape 11 of the resilient member 1.

When the push switch 100 is pressed down from above an upper surface 12*a* of the film 12, the flat portion 1*c* of the resilient member 1 is pressed down through the film 12.

Accordingly, an end 1*e* of the protrusion 1*d* that protrudes outward and downward with an oblique angle from the outer edge 1*cc* of the flat portion 1*c* becomes in contact with a second electrode 8*b* arranged on the upper surface 7*a* of the electrically-insulating member 7, and a first electrode 8*a* and the second electrode 8*b* are electrically connected by the resilient member 1.

Figure 1D:
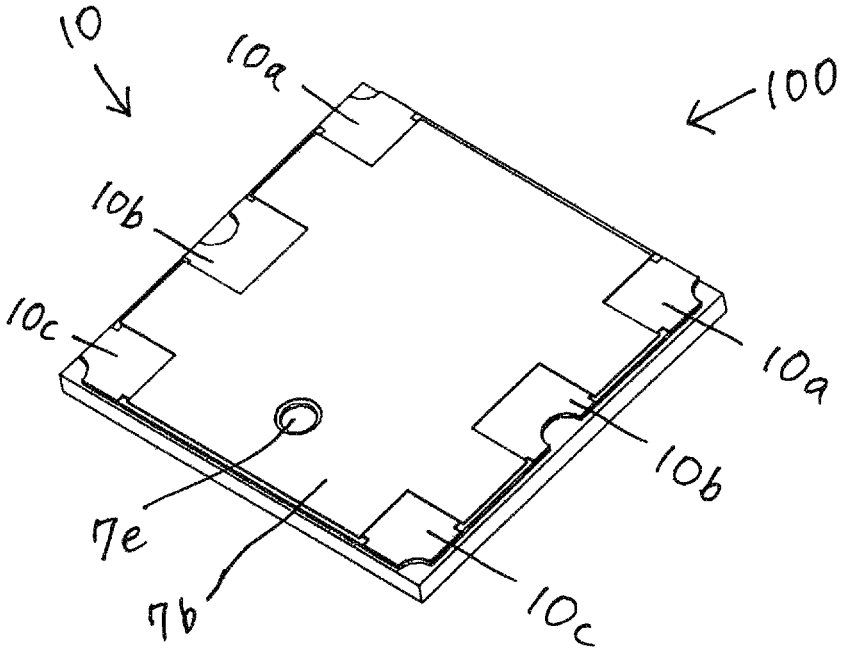
FIG. 1D is a bottom perspective view of & the push switch according to the first embodiment of the subject matter, showing an example of arrangement of lower electrodes arranged on a lower surface of an electrically-insulating member.
Figure 1E:
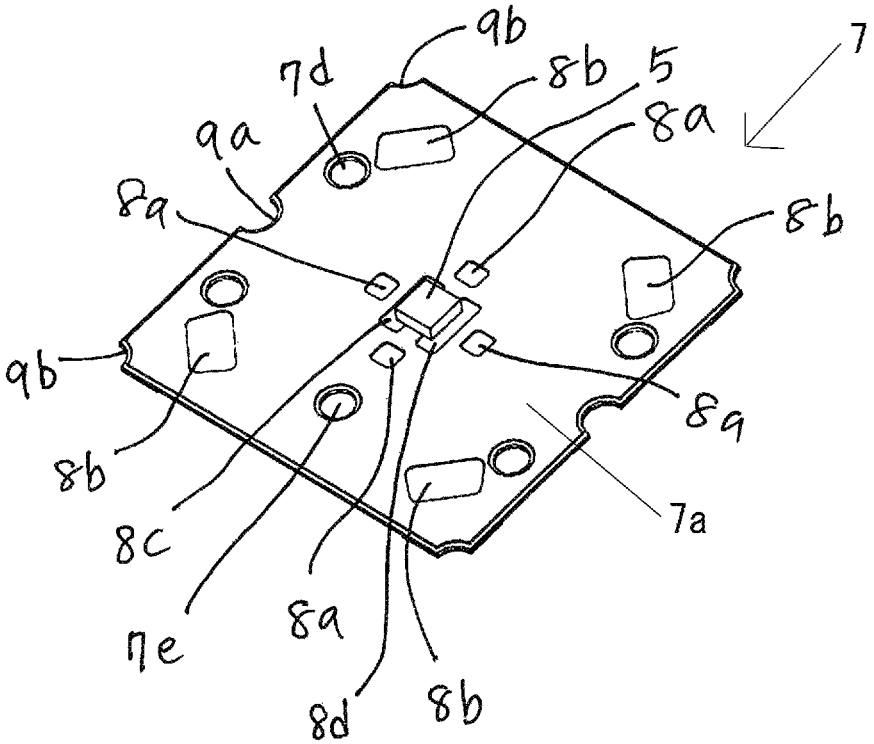
FIG. 1E is a top perspective view of the electrically-insulating member including upper electrodes on which a light-emitting element is electrically mounted.
Figure 1F:
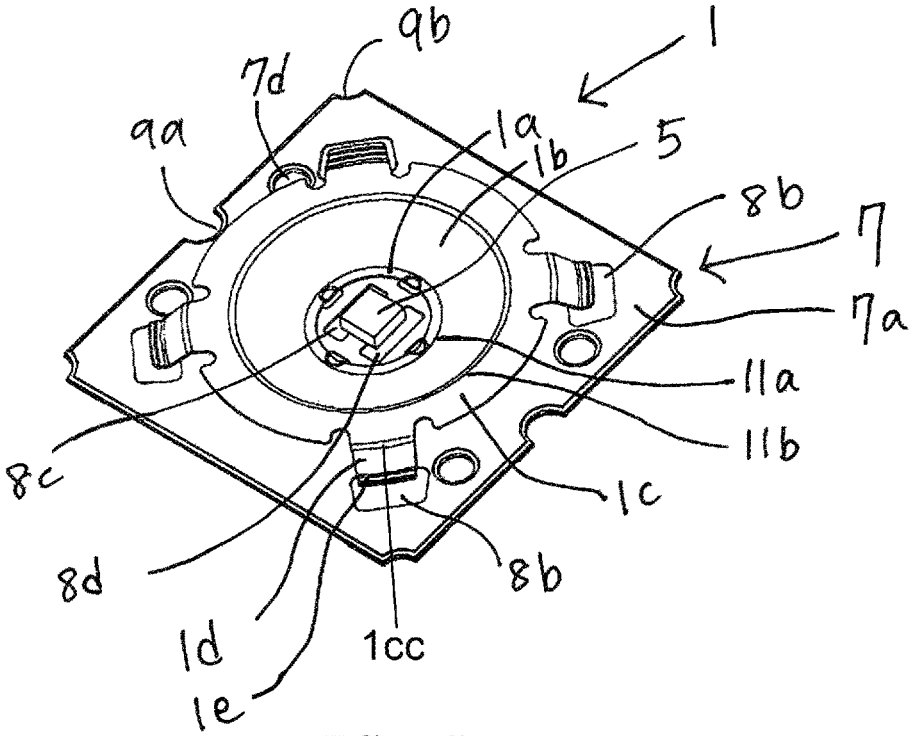
FIG. 1F is a top perspective view of the electrically-insulating member including upper electrodes, on which the light-emitting element is electrically mounted, and further including upper electrodes, on which a resilient member is electrically mounted.
Figure 1G:
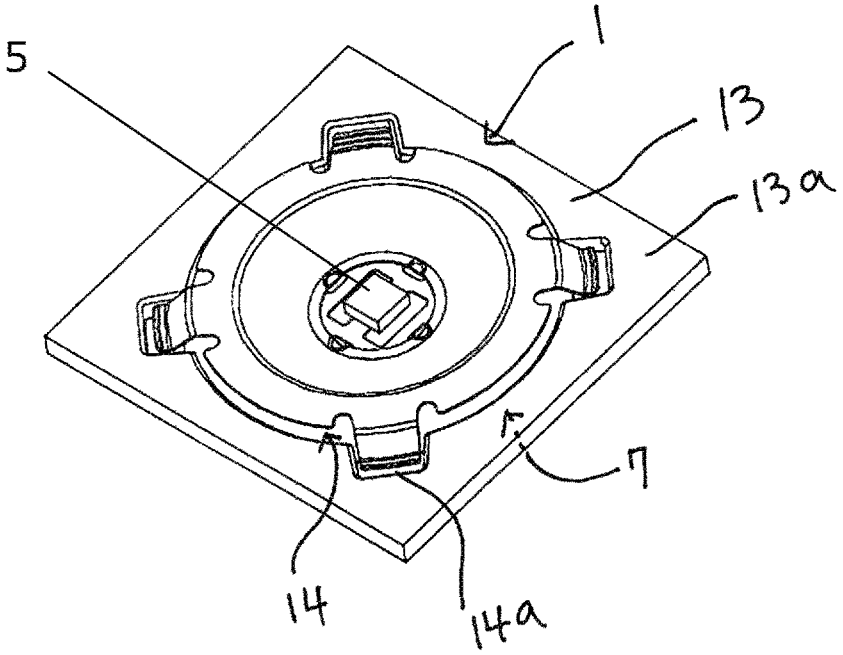
FIG. 1G is a top perspective view of a frame including an opening in which the light-emitting element and the resilient member electrically mounted on the electrically-insulating member in FIG. 1F are arranged.

The at least two protrusions may be four protrusions as in FIG. 1F and FIG. 1G for example. The four protrusions 1*d* each protrude outward and downward with an oblique angle from the outer edge 1*cc* of the flat portion 1*c*. The four protrusions 1*d* may be arranged at the outer edge 1*cc* of the flat portion 1*c* with an equal distance to an adjacent protrusion of the four protrusions. Accordingly, four electrical contacts may be obtained by the resilient member 1 in four directions.

An example of arrangement of lower electrodes 10 (10*a*, 10*b*, and/or 10*c*) of the electrically-insulating member 7 is illustrated in FIG. 1D.

FIG. 1E is a top perspective view of the electrically-insulating member 7 including electrodes 8*c* and 8*d* on which a light-emitting element 5 is electrically mounted. The electrically-insulating member 7 may be used in a push switch according to an embodiment of the subject matter.

For more details, the push switch 100 includes the electrically-insulating member 7. The push switch 100 further includes upper electrodes 8 arranged on the upper surface 7*a* of the electrically-insulating member 7. The upper electrodes 8 include the first electrode 8*a* and the second electrode 8*b* that is positioned outside of the first electrode 8*a*.

The first electrode 8*a* may be arranged to be around a third electrode 8*c* and a fourth electrode 8*d* to which the light-emitting element 5 may be electrically mounted.

Also, the second electrode 8*b* may be arranged to be around the first electrode 8*a*.

The push switch 100 further includes the resilient member 1. The resilient member 1 further includes an annular portion 1*a* that defines the opening 2. The annular portion 1*a* is positioned adjacent to an inner edge 11*a* of the concave shape 11. The annular portion 1*a* is arranged to be in contact with the first electrode 8*a* of the electrodes 8. The annular portion 1*a* may include a flat surface to be in contact with the first electrode 8*a*. The push switch 100 further includes the light-emitting element 5 arranged in the opening 2 that is positioned at the center of the concave shape 11 of the resilient member 1. The concave shape 11 of the resilient member 1 surrounds the light-emitting element 5.

The resilient member 1 may include the curved surface 1*b* at the concave shape 11. The curved surface 1*b* of the concave shape 11 may be a polished surface to reflect light from the light-emitting element 5. The resilient member 1 further includes the flat portion 1*c* that protrudes outward from the outer edge 11*b* of the concave shape 11 and the protrusion 1*d* protruding outward and downward with an oblique angle from the outer edge 1*cc* of the flat portion 1*c*. The protrusion 1*d* of the resilient member 1 includes the end 1*e* that is arranged above the second electrode 8*b*.

When the push switch 100 is pressed down from above the upper surface 12*a* of the film 12, the flat portion 1*c* of the resilient member 1 is pressed down through the film 12.

Accordingly, the end 1*e* of the protrusion 1*d* that protrudes outward and downward with an oblique angle from the outer edge 1*cc* of the flat portion 1*c* becomes in contact with the second electrode 8*b* arranged on the upper surface 7*a* of the electrically-insulating member 7, and the first electrode 8*a* and the second electrode 8*b* are electrically connected by the resilient member 1.

In this embodiment, it is possible to arrange a light-emitting element 5 at a center of a push switch; and the curved surface 1*b* of the concave shape 11 of the resilient member 1 is configured to reflect light from the light-emitting element 5 upward.

As noted above, the light-emitting element 5 is positioned in the opening 2 of the resilient member 1, and the opening 2 of the resilient member 1 is positioned at a the bottom of the concave shape 11. The light-emitting element 5 may be electrically mounted on the third electrode 8*c* and the fourth electrode 8*d*. The opening 2 of the resilient member 1 may have a diameter in a range of 0.5 mm to 5 mm. The size of the opening 2 of the resilient member 1 may vary depending on a size of push switch.

In FIG. 1F, the electrically-insulating member 7 includes upper electrodes 8*c*, 8*d*, on which the light-emitting element 5 is electrically mounted, and further includes upper electrodes 8*a* (not shown), on which the resilient member 1 is electrically mounted. The electrically-insulating member 7 may be a substrate made of resin, for example. The substrate may be used as an electrically-insulating member in a push switch, according to an embodiment of the subject matter.

In FIG. 1G frame 13 includes an opening 14 in which the light-emitting element 5 and the resilient member 1 electrically mounted on the electrically-insulating member 7 of FIG. 1F are arranged. The frame 13 including the opening 14 is arranged on the electrically insulating member 7.

The push switch 100 may include the frame 13. Alight-emitting element and a resilient member might be electrically mounted on upper electrodes 8 arranged on an upper surface 7*a* of the electrically-insulating member 7 in the opening 14 of the frame 13. The electrically-insulating member 7 and the frame 13 may be provided as separate elements. The frame 13 may be adhered to the upper surface 7*a* of the electrically-insulating member 7. The light-emitting element 5 and the resilient member 1 may be positioned in the opening 14 of the frame 13. The opening 14 may have a shape in which the resilient member 1 fits. The opening 14 of the frame 13 may include a notch 14*a* as a part of the opening 14. The protrusion 1*d* of the resilient member 1 may be fit in the notch 14*a*. The flat portion 1*c* of the resilient member 1 may be positioned higher than the upper surface 13*a* of the frame 13, as in FIG. 1B.

Also, the electrically-insulating member 7 and the frame 13 may be provided as an integral resin body including a recess in which the light-emitting element 5 and & the resilient member 1 are arranged.

The light-emitting element 5 and the resilient member 1 may be electrically mounted on the electrically-insulating member 7 in the opening 14 of the frame 13. The electrically-insulating member 7 and the frame 13 may be provided as separate elements. Also, the electrically-insulating member 7 and the frame 13 may be provided as a resin body including a recess in which a light-emitting element 5 and a resilient member 1 are arranged.

The light-emitting element 5 and the resilient member 1 are electrically mounted on the electrically-insulating member 7 in the opening 14 of the frame 13. The electrically-insulating member 7 and the frame 13 may be provided as separate elements. Also, the electrically-insulating member 7 and the frame 13 may be provided as a resin body including a recess in which upper electrodes 8 are arranged and the light-emitting element 5 and the resilient member 1 are electrically connected to the upper electrodes 8.

When the light-emitting element 5 is activated to emit light by application of voltage to the light-emitting element 5 through upper electrodes 8, the concave shape 11 of the resilient member 1 is configured to reflect light from the light-emitting element 5 upward.

The resilient member 1 may be made of metal. The resilient member 1 may be made of stainless steel.

Furthermore, when the push switch 100 is pressed down from above, the flat portion 1*c* of the resilient member 1 is pressed down from above.

Accordingly, the end 1*e* of the protrusion 1*d* that protrudes outward and downward with an oblique angle from the outer edge 1*cc* of the flat portion 1*c* becomes in contact with the second electrode 8*b* arranged on the upper surface 7*a* of the electrically-insulating member 7, and the first electrode 8*a* and the second electrode 8*b* are electrically connected by the resilient member 1.

The electrically-insulating member 7 may be a substrate including a resin. The substrate may include a through-hole that passes through the substrate from an upper surface to a lower surface of the substrate. Also, an electrode arranged on an upper surface 7*a* of the electrically-insulating member 7 may be electrically connected to the through-hole. Furthermore, it is possible to arrange an electrode pattern on the upper surface 7*a* of the electrically-insulating member 7, a through-hole that may be a ½ through-hole 9*a* at a side 7*c* of the substrate and/or a through-hole that may be a ¼ through-hole 9*b* at a corner of the electrically-insulating member 7.

The number, shape and arrangement of electrodes, wiring pattern, and/or through-holes are freely chosen for electrical connections to the resilient member 1 and/or the light-emitting element 5, for example.

Also, the electrically-insulating member 7 may be a resin body including metal leads, which may be electrically connected to the resilient member 1. Also, the metal leads may be electrically connected to the light-emitting element 5.

Furthermore, the electrically-insulating member 7 may include a casing in which the resilient member 1 may be arranged.

Accordingly, metal leads and/or a lead frame may be arranged in and/or on the electrically-insulating member 7 in combination with electrodes or instead of electrodes and/or through-holes.

For more details, the upper electrodes 8 further includes the third electrode 8*c* and the fourth electrode 8*d* to that the light-emitting element 5 is electrically connected.

A push switch 200 according to a second embodiment of the subject matter will be described with reference to FIGS. 2A to 2G.

The push switch 200 includes a resilient member 1 made of metal. The resilient member 1 includes a concave shape 11 and an opening 2 that is positioned at a center of the concave shape 11. The push switch 200 further includes a light-emitting element 5 arranged in the opening 2 that is positioned at the center of the concave shape 11 of the resilient member 1. The opening 2 is positioned at the a bottom of the concave shape 11.

The push switch 200 may include a film 12 arranged over the resilient member 1 with the opening 2 in which the light-emitting element 5 is arranged. The film 12 is a light-transmitting film made of resin.

Light emitted from the light-emitting element 5 and reflected light on a curved surface 1*b* in the concave shape 11 of the resilient member 1 are configured to transmit the film 12 that may be transparent or translucent.

The opening 2 of the resilient member 1 is positioned at the bottom of the concave shape 11 of the resilient member 1.

The opening 2 of the resilient member 1 may have a diameter in a range of 0.5 mm to 5 mm. The size of the opening 2 of the resilient member 1 may vary depending on a size of the push switch.

As noted above, the push switch 200 includes the resilient member 1 including the concave shape 11 and the opening 2 that is positioned at the center of the concave shape 11. The resilient member 1 further includes a flat portion 1*c* that is extended outward from an outer edge 11*b* of the concave shape 11, and a protrusion 1*d* protruding outward and downward with an oblique angle from an outer edge 1*cc* of the flat portion 1*c*.

The push switch 200 further includes the light-emitting element 5 arranged in the opening 2 that is positioned at the center of the concave shape 11 of the resilient member 1.

Figure 2A:
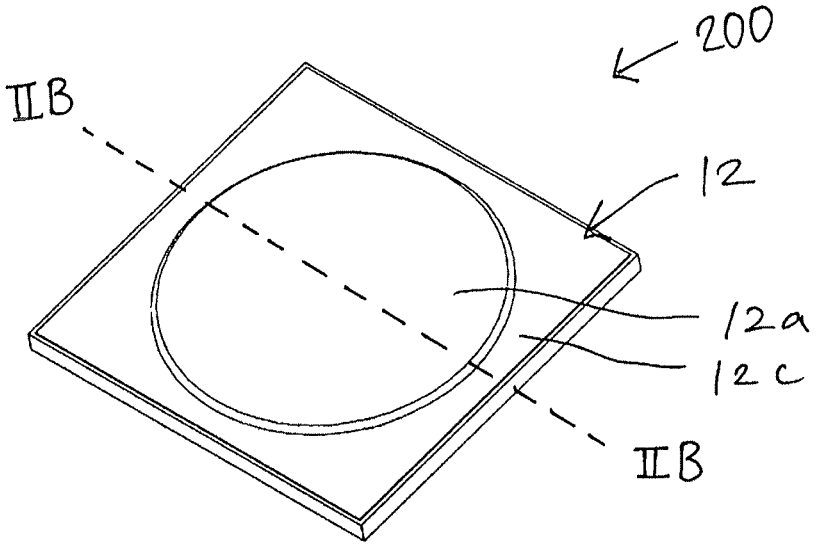
FIG. 2A is a top perspective view of a push switch according to a second embodiment of the subject matter.
Figure 2B:
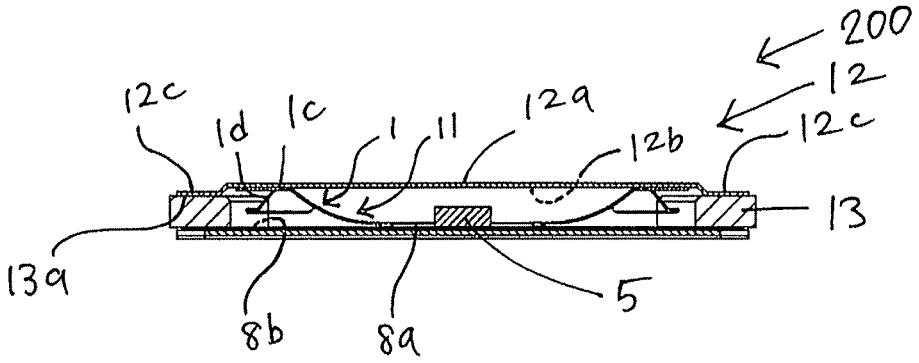
FIG. 2B is a cross-sectional view of the push switch, taken along a dotted line IIB of FIG. 2A.
Figure 2C:
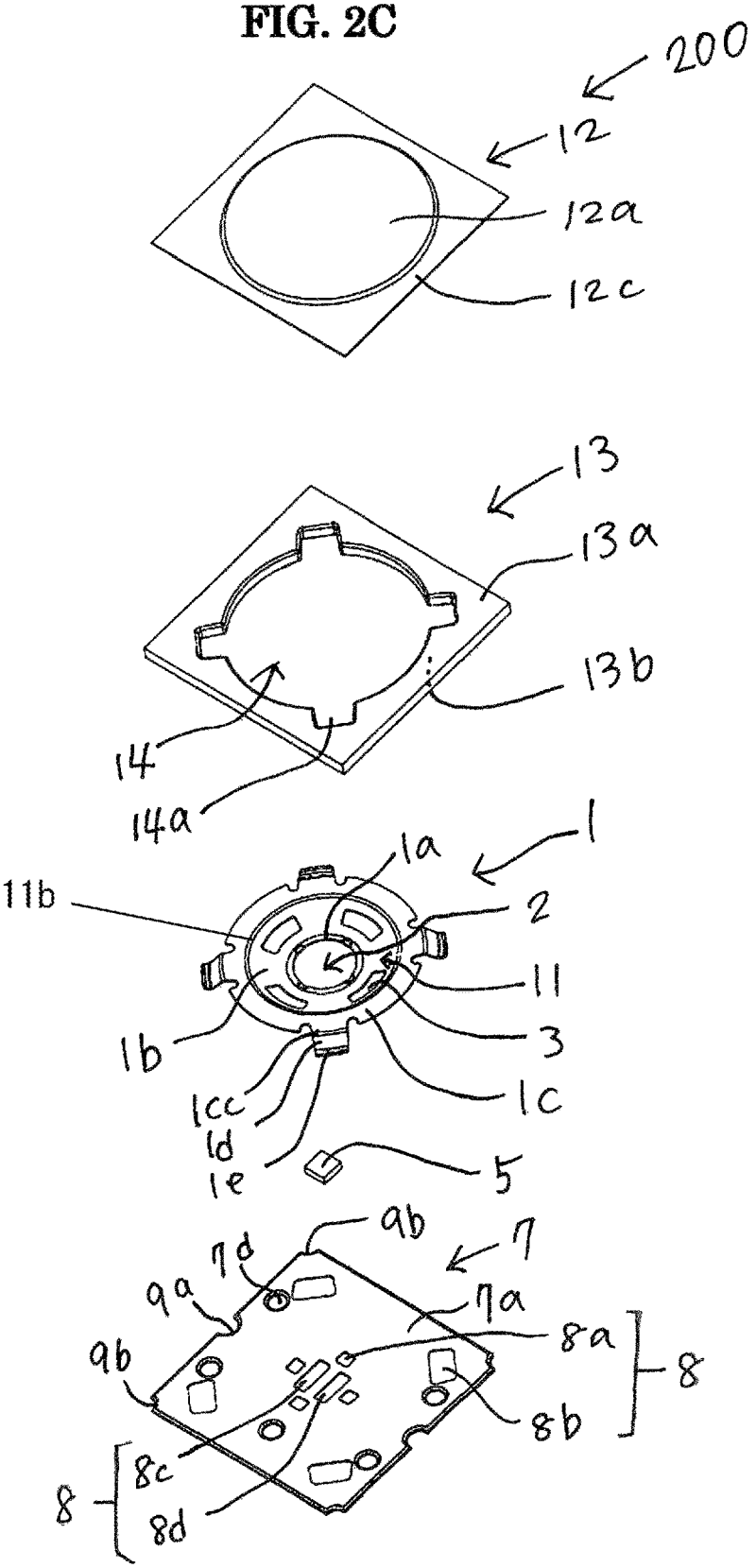
FIG. 2C is an exploded perspective view of the push switch according to the second embodiment of the subject matter.
Figure 2D:
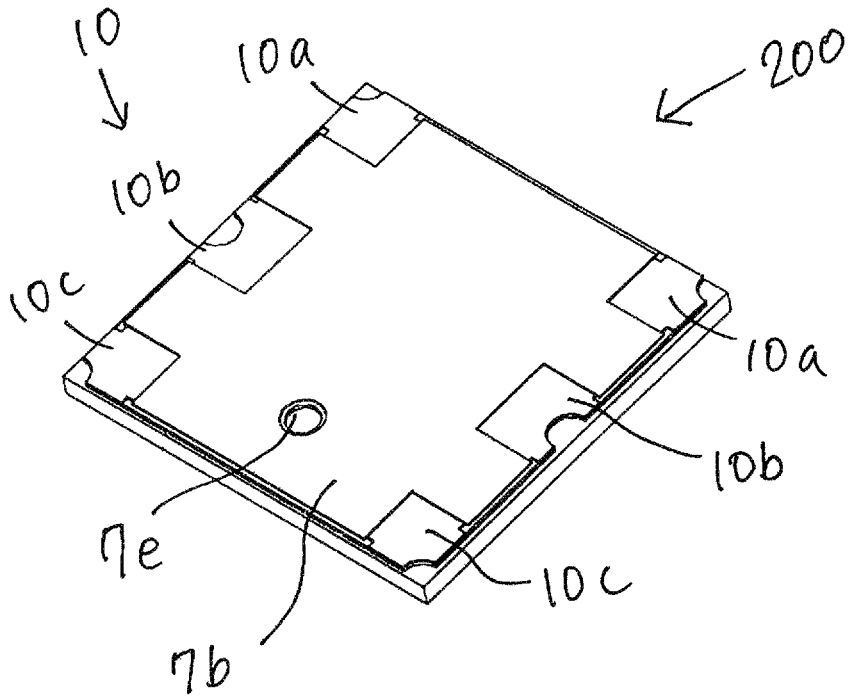
FIG. 2D is a bottom perspective view of the push switch according to the second embodiment of the subject matter, showing an example of arrangement of lower electrodes, arranged on a lower surface of an electrically-insulating member.

An example of arrangement of lower electrodes 10 arranged on a lower surface 7*b* of an electrically-insulating member 7 is illustrated in FIG. 2D. The lower electrodes 10 (10*a*, 10*b*, and/or 10*c*) of the electrically-insulating member 7 may be electrically connected to electrodes of a mother-board of an electronic device.

The number, shape and arrangement of electrodes, wiring pattern, and/or through-holes are freely chosen for electrical connections to the resilient member 1 and/or the light-emitting element 5, for example.

Figure 2E:
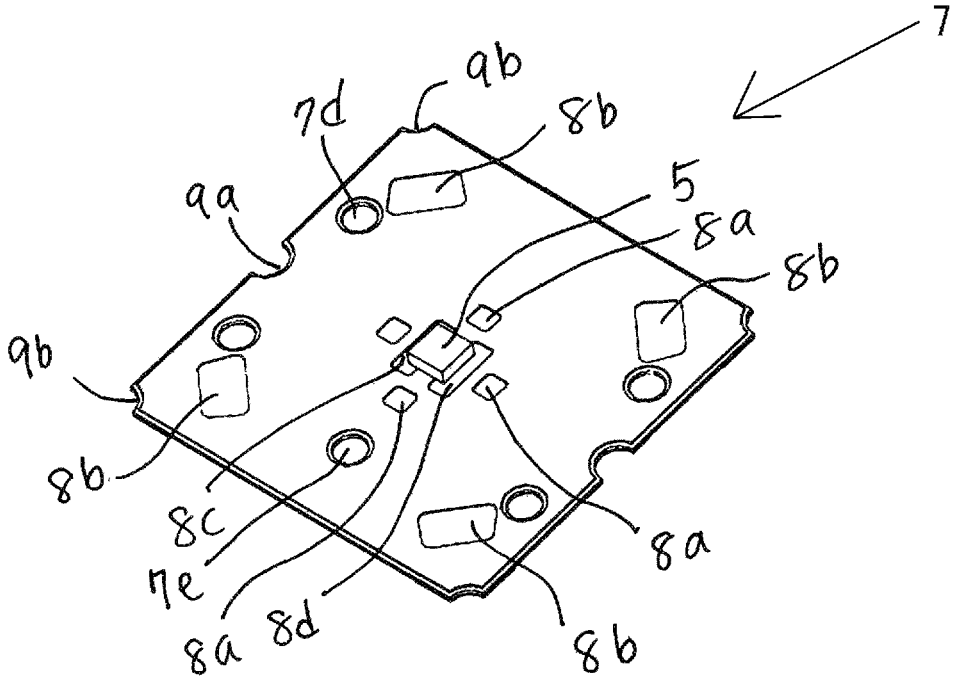
FIG. 2E is a top perspective view of the electrically-insulating member including upper electrodes on which a light-emitting element is electrically mounted.

As in FIG. 2E, the electrically-insulating member 7 includes upper electrodes 8 on which the light-emitting element 5 is electrically mounted. The electrically-insulating member 7 may be used in a push switch according to an embodiment of the subject matter.

Figure 2F:
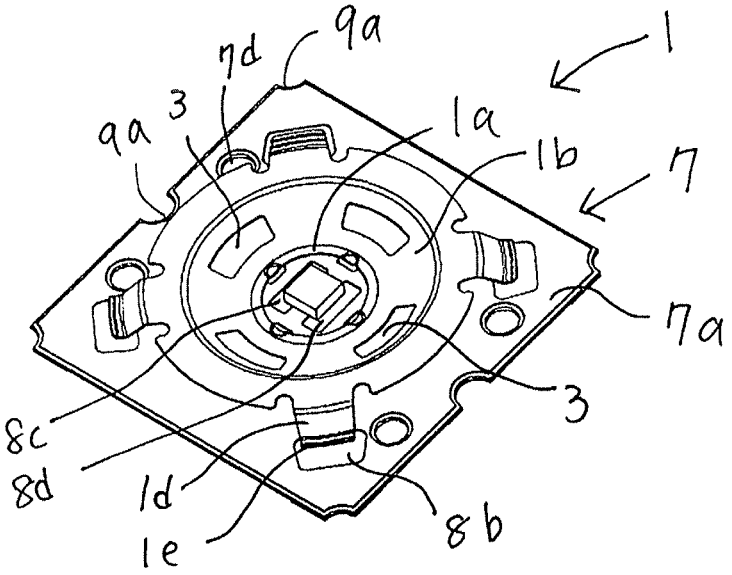
FIG. 2F is a top perspective view of the electrically-insulating member including upper electrodes on which the light-emitting element and a resilient member are electrically mounted.

As in FIG. 2F, the electrically-insulating member 7 includes the upper electrodes 8 on which the light-emitting element 5 and the resilient member 1 are electrically mounted. The electrically-insulating member 7 may be a substrate. The substrate may be used in a push switch according to an embodiment of the subject matter.

For more details, the push switch 200 includes the electrically-insulating member 7. The push switch 200 further includes the upper electrodes 8 arranged on an upper surface 7*a* of the electrically-insulating member 7. The upper electrodes 8 include a first electrode 8*a* and a second electrode 8*b* that is positioned outside of the first electrode 8*a*.

The first electrode 8*a* may be arranged to be around a third electrode 8*c* and a fourth electrode 8*d* to which the light-emitting element 5 may be electrically mounted. The first electrode 8*a* may include one or more upper electrodes.

Also, the second electrode 8*b* may be arranged to be around the first electrode 8*a*. The second electrode 8*b* may include one or more upper electrodes.

The push switch 200 includes the resilient member 1. The resilient member 1 includes an annular portion 1*a* that defines the opening 2. The annular portion 1*a* is arranged to be in contact with the first electrode 8*a* of the electrodes 8. The annular portion 1*a* may include a flat surface to be in contact with the first electrode 8*a*. The push switch 200 further includes the light-emitting element 5 arranged in the opening 2 that is positioned at the center of the concave shape 11 of the resilient member 1. The concave shape 11 of the resilient member 1 surrounds the light-emitting element 5.

The resilient member 1 may include the curved surface 1*b* at the concave shape 11. The curved surface 1*b* of the concave shape 11 may be a polished surface to reflect light from the light-emitting element 5. The resilient member 1 further includes the flat portion 1*c* that is extended outward from an outer edge 11*b* of the concave shape 11 and a protrusion 1*d* protruding outward and downward with an oblique angle from the outer edge 1*cc* of the flat portion 1*c*. The protrusion 1*d* of the resilient member 1 includes an end 1*e* that is arranged above the second electrode 8*b*.

In this embodiment, it is possible to arrange a light-emitting element at a center of a push switch and the concave shape of the resilient member 1.

The curved surface 1*b* of the concave shape 11 of the resilient member 1 may further include one or more openings 3. The one or more openings 3 may guide light sideways of the resilient member 1.

Also, the one or more openings 3 passing through the curved surface 1*b* of the concave shape 11 of the resilient member 1 are configured to pass light from the light-emitting element 5 through the one or more openings 3 sideways.

Accordingly, the push switch 200 according to this embodiment may emit light with a wider angle, sideways as well as upward, compared to the push switch 100 according to the first embodiment.

The push switch 200 may include the film 12. The film 12 is a light-transmitting film. Also, the push switch 200 may further include a frame 13. The frame 13 may be made of light-transmitting resin to transmit light emitted from the light-emitting element 5. The electrically-insulating member 7 may be made of white-colored resin to reflect light.

The light-emitting element 5 and the resilient member 1 may be electrically mounted on the third electrode 8*c* and the fourth electrode 8*d* of the upper electrodes 8 arranged on the upper surface 7*a* of the electrically-insulating member 7 in an opening 14 of the frame 13.

The electrically-insulating member 7 and the frame 13 may be provided as separate elements. The frame 13 may be adhered to the upper surface 7*a* of the electrically-insulating member 7. The frame 13 may include the opening 14 having a shape in which the resilient member 1 fits. The light-emitting element 5 and the resilient member 1 may be positioned in the opening 14 of the frame 13.

Figure 2G:
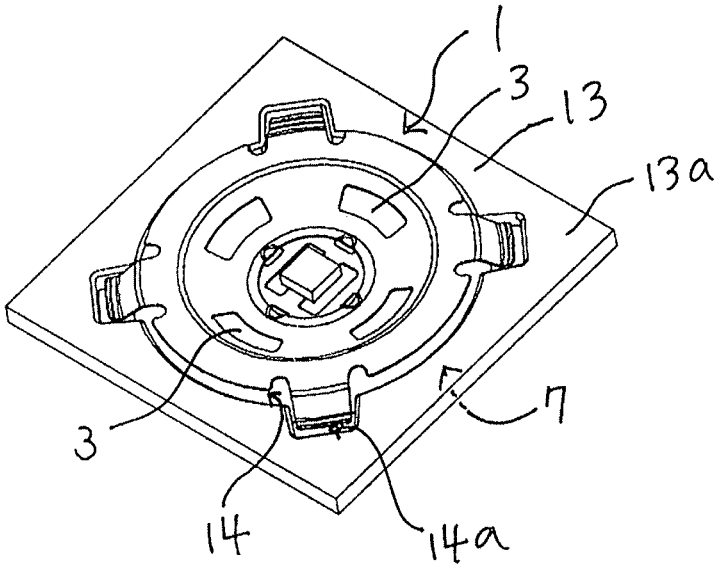
FIG. 2G is a top perspective view of a frame including an opening in which the light-emitting element and the resilient member electrically mounted on the electrically-insulating member in FIG. 2F are arranged. The frame is arranged on the electrically insulating member.

As in FIG. 2G the electrically-insulating member 7 on which the frame 13 including the opening 14 is arranged. The light-emitting element 5 and the resilient member 1 may be electrically mounted on the electrically-insulating member 7 in the opening 14 of the frame 13.

The electrically-insulating member 7 and the frame 13 may be provided as separate elements. The frame 13 may be adhered on the upper surface 7*a* of the electrically-insulating member 7. Also, the electrically-insulating member 7 and the frame 13 may be provided as a resin body including a recess in which the light-emitting element 5 and the resilient member 1 are arranged.

Figure 3A:
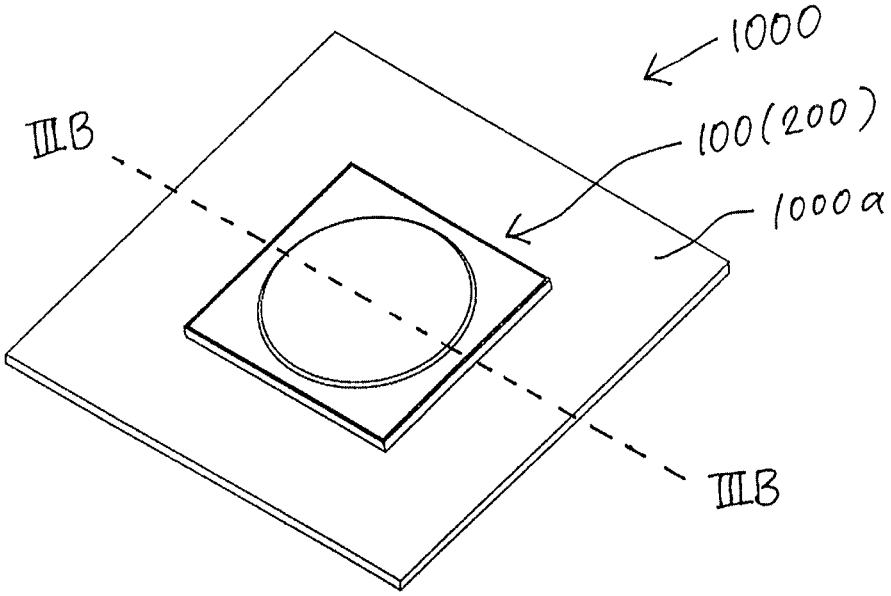
FIG. 3A is a motherboard of an electronic device and a push switch, according to an embodiment of the subject matter. The push switch is electrically connected to the motherboard.

FIG. 3A illustrates a motherboard 1000 of an electronic device, and a push switch 100 and/or 200 is electrically connected to the motherboard 1000.

Figure 3B:
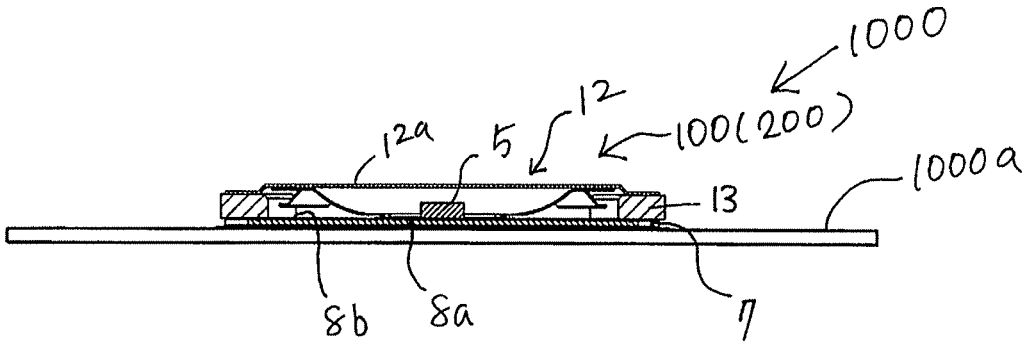
FIG. 3B is a cross-sectional view of the push switch that is electrically connected to the motherboard of the electronic device, taken along a dotted line IIB of FIG. 2A.

FIG. 3B is a cross-sectional view of the push switch 100 and/or 200 on the motherboard 1000, taken along a dotted line IIB of FIG. 3A.

The lower electrodes 10 (10*a*, 10*b*, and/or 10*c*) of the electrically-insulating member 7 may be electrically connected to electrodes of a motherboard of an electronic device. The lower electrodes 10 (10*a*, 10*b*, and/or 10*c*) of the push switch may be soldered on electrodes arranged on an upper surface 1000*a* of the motherboard 1000

An electronic device includes a motherboard 1000 and a push switch according to the subject matter disclosed herein. The motherboard 1000 includes electrodes that may include a first electrode 8*a* and a second electrode 8*b* to which the push switch 100 and/or 200 is electrically connected.

Figure 4:
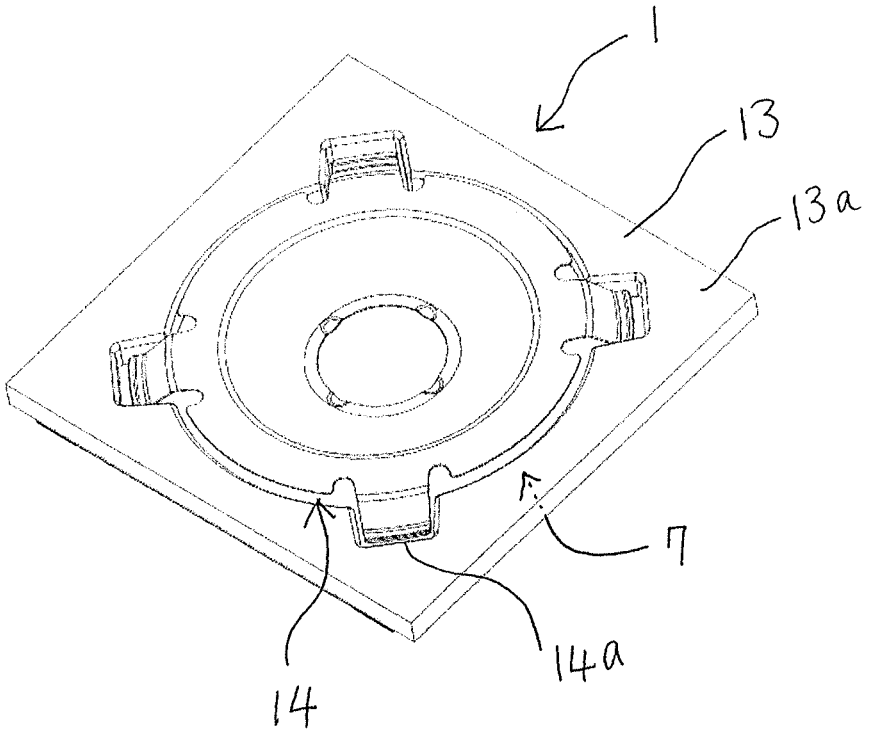
FIG. 4 is a top perspective view of a frame including an opening, in which the resilient member electrically mounted on the electrically-insulating member of FIG. 1F is arranged. The frame is arranged on the electrically insulating member. In this embodiment, a light-emitting element may not be arranged.

In FIG. 4, a frame 13 including an opening 14, in which the resilient member 1 electrically mounted on the electrically-insulating member 7 of FIG. 1F is arranged. The frame 13 is arranged on the electrically insulating member 7. In this embodiment, a light-emitting element may not be arranged in a center of the resilient member 1.

In this embodiment, the resilient member 1 includes four protrusions 1*d* each protruding outward and downward with an oblique angle from the outer edge 1*cc* of the flat portion 1*c*. The four protrusions 1*d* may be arranged at the outer edge 1*cc* of the flat portion 1*c* with an equal distance to an adjacent protrusion of the four protrusions. Accordingly, four electrical contacts may be obtained by the resilient member 1 in four directions, and a four-way key may be arranged over the resilient member 1.

Various electronic devices include push switches. An electronic device includes the push switch according to an embodiment of the subject matter, and a motherboard includes a first electrode and a second electrode. The push switch may be electrically connected to the first electrode and the second electrode of the motherboard of the electronic device.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

What is claimed is:

1. A push switch comprising:

a resilient member being made of metal, the resilient member comprising:

a concave shape being recessed downward in a plan view, and having a bowl shape and a curved surface;

an opening being positioned at a center of a bottom of the concave shape; and at least two protrusions each protruding outward and downward with an oblique angle around the concave shape;

a light-emitting element being arranged in the opening that is positioned at the center of the bottom of the concave shape of the resilient member, the curved surface of the concave shape of the resilient member surrounding the light-emitting element, and being configured to reflect light emitted from the light emitting element upward;

an electrically-insulating member comprising upper electrodes being arranged on an upper surface of the electrically-insulating member, wherein the upper electrodes comprise at least one first electrode and at least one second electrode, the at least one second electrode being positioned outside of the at least one first electrode, and the center of the bottom of the concave shape of the resilient member is in constant contact with the at least one first electrode, at least one of the at least two protrusions being arranged above the at least one second electrode; and a film comprising a light-transmitting resin, the film being arranged over the resilient member, wherein the at least one of the at least two protrusions coming into electric contact with the at least one second electrode when the film is pressed down from above.

2. The push switch according to claim 1, wherein the curved surface of the concave shape surrounding the light-emitting element comprises one or more openings.

3. The push switch according to claim 1, wherein the opening that is positioned at the center of the concave shape of the resilient member has a diameter in a range of 0.5 mm to 5 mm.

4. The push switch according to claim 1, wherein the resilient member further comprises a flat portion that is extended outward from an outer edge of the concave shape, the at least two protrusions includes four protrusions each protruding outward and downward with an oblique angle from an outer edge of the flat portion, the at least one second electrode includes four second electrodes, and the four protrusions each include an end being arranged above one of the four second electrodes.

5. The push switch according to claim 4, wherein the film further comprises an upper surface, a lower surface, and a peripheral surface surrounding the upper surface, the upper surface of the film and the lower surface of the film corresponding to the upper surface of the film are raised by at least one step from the peripheral surface of the film, and the flat portion of the resilient member is positioned higher than the peripheral surface of the film, and arranged in constant contact with the lower surface of the film corresponding to the upper surface of the film.

6. An electronic device comprising:

the push switch of claim 1; and a motherboard comprising at least one first electrode and at least one second electrode, wherein the push switch is electrically connected to the at least one first electrode and the at least one second electrode of the motherboard.

7. A push switch comprising:

an electrically-insulating member comprising upper electrodes being arranged on an upper surface of the electrically-insulating member, the upper electrodes comprising:

at least one first electrode; and at least one second electrode, the at least one second electrode being positioned outside of the at least one first electrode;

a resilient member being made of metal, the resilient member comprising:

a concave shape being recessed downward in a plan view, and having a bowl shape and a curved surface;

an opening being positioned at a center of a bottom of the concave shape;

an annular portion defining the opening and being in constant contact with the at least one first electrode of the upper electrodes;

a flat portion extending outward from an outer edge of the concave shape; and at least two protrusions protruding outward and downward with an oblique angle from an outer edge of the flat portion, the at least two protrusions of the resilient member each comprising an end that is arranged above the at least one second electrode;

a light-emitting element being arranged in the opening that is positioned at the center of the bottom of the concave shape of the resilient member, the curved surface of the concave shape of the resilient member surrounding the light-emitting element, and being configured to reflect light emitted from the light-emitting element upward; and a film comprising a light-transmitting resin, the film being arranged over the resilient member.

8. The push switch according to claim 7, wherein the upper electrodes on the upper surface of the resilient member further comprise a third electrode and a fourth electrode electrically connected to the light-emitting element.

9. The push switch according to claim 7, wherein the curved surface of the concave shape surrounding the light-emitting element comprises one or more openings.

10. The push switch according to claim 7, wherein the opening that is positioned at the center of the bottom of the concave shape of the resilient member has a diameter in a range of 0.5 mm to 5 mm.

11. The push switch according to claim 7, wherein the film further comprises an upper surface, a lower surface, and a peripheral surface surrounding the upper surface, the upper surface of the film and the lower surface of the film corresponding to the upper surface the of the film are raised by at least one step from the peripheral surface, and the flat portion of the resilient member is positioned higher than the peripheral surface of the film, and arranged in constant contact with the lower surface of the film corresponding to the upper surface of the film.

* * * * *